US006344804B1

(12) United States Patent
Koga

(10) Patent No.: US 6,344,804 B1
(45) Date of Patent: Feb. 5, 2002

(54) VEHICLE-ONBOARD ETC APPARATUS AND METHOD WITH VISIBLE/AUDIBLE ETC-RELEVANT INFORMATION MESSAGING

(75) Inventor: Toshio Koga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/688,833

(22) Filed: Oct. 17, 2000

(30) Foreign Application Priority Data

Mar. 31, 2000 (JP) ..... 12-097711

(51) Int. Cl.[7] ..... G08G 1/00

(52) U.S. Cl. ..... 340/928; 340/933; 340/991; 340/994; 235/380; 235/384

(58) Field of Search ..... 340/928, 933, 340/991, 994; 235/384, 380, 379

(56) References Cited

U.S. PATENT DOCUMENTS 5,086,389 A * 2/1992 Hassett et al. ..... 340/928
5,214,793 A * 5/1993 Conway et al. ..... 340/905
5,451,758 A * 9/1995 Jesadanont ..... 340/928
5,872,525 A * 2/1999 Fukasawa et al. ..... 340/928

* cited by examiner

*Primary Examiner*—Jeffery Hofsass
*Assistant Examiner*—Daniel Previl
(74) *Attorney, Agent, or Firm*—Sughrue Mion, PLLC

(57) ABSTRACT

A vehicle-onboard ETC apparatus mounted on a motor vehicle which informs a driver of ETC-relevant information interchanged with an ETC facility installed at a toll gate via an image as well as a voice, and which requires minimal extension of hardware. The apparatus determines and discriminates field intensity for received ETC-relevant information without using any specific measuring apparatus, while outputting the field intensity information as an image or voice. The apparatus includes a communication unit for interchanging toll charge/payment information with the ETC facility of the toll gate when the motor vehicle passes through the toll gate, signal conversion means for converting the received toll charge/payment information into an image signal and a voice signal, a display device for displaying the image signal resulting from the conversion, and a voice signal output unit for outputting the voice signal resulting from the conversion through an audible signal converting unit.

16 Claims, 10 Drawing Sheets

VEHICLE-ONBOARD ETC APPARATUS AND METHOD WITH VISIBLE/AUDIBLE ETC-RELEVANT INFORMATION MESSAGING

BACKGROUND OF THE INVENTION

1. Field of the Invention

The present invention relates to a vehicle-onboard electronic toll collection or ETC communication apparatus which is mounted on a motor vehicle or an automobile or a car for conveying to a driver of the motor vehicle toll charge/payment information interchanged or exchanged with electronic toll collection or ETC system facility installed at a toll gate in the form of a displayed image and a voice message, respectively.

2. Description of Related Art

For having better understanding of the present invention, description will first be made in some detail of a conventional vehicle-onboard ETC apparatus known heretofore.

FIG. 9 is a block diagram showing schematically a general arrangement of a hitherto known vehicle-onboard ETC apparatus. Referring to the figure, reference numeral 1 denotes an antenna mounted on a motor vehicle (hereinafter referred to also as the vehicle-mounted antenna) for interchanging or exchanging (i.e., receiving/sending) the ETC-relevant information such as toll gate position information, toll charge/payment information, ID code information inherent or specific to the motor vehicle and the like with a toll collection transaction antenna (also referred to as the on-road overhead antenna) installed at the toll gate station of a toll road (not shown). Further, reference numeral 2 denotes a cable for the vehicle-onboard ETC apparatus (hereinafter this cable will be referred to as the vehicle-mounted cable) through which the ETC-relevant information is transferred between the vehicle-mounted antenna 1 and the vehicle-onboard ETC apparatus denoted generally by reference numeral 10.

As can be seen in FIG. 9, the vehicle-onboard apparatus 10 is comprised of a transmitter/receiver unit 3 for interchanging by radio waves the ETC-relevant information with a corresponding unit of the ETC communication facility or equipment installed at the toll gate station through the medium of the vehicle-mounted antenna 1 and the on-road overhead antenna, a control unit 4 for generating the ETC-relevant information to be sent to the ETC equipment of the toll gate station through the transmitter/receiver unit 3 while processing the ETC-relevant information received through the transmitter/receiver unit 3 into a signal for displaying a corresponding image, a manipulating unit 8 for performing signal input/output operations, input/output signal gain setting operations and others for the control unit 4, a display device 5 designed for displaying the received ETC-relevant information as an image while displaying the ETC-relevant information sent to the toll gate from the vehicle-onboard ETC apparatus as an image for the monitoring purpose and a power supply source 7.

Parenthetically, the manipulating unit 8 and the display device 5 cooperate to constitute a man-machine interface unit which serves as an intermediation medium for enabling communication between the vehicle-onboard ETC apparatus 10 and the driver of the motor vehicle.

FIG. 10 is a block diagram showing generally a circuit arrangement of the transmitter/receiver unit 3 known in the art.

Referring to the figure, the transmitter/receiver unit 3 is comprised of a detector diode D for detecting the ETC-relevant information signal emitted from the on-road overhead antenna A1 installed at a toll gate TG and received by the vehicle-mounted antenna 1, a detecting circuit 3-1 for detecting the level of the received signal as detected by the detector diode D, a demodulating circuit 3-2 for demodulating the received signal as detected to thereby restore the original ETC-relevant information which is then supplied to the control unit 4 as the received data, and a modulating circuit 3-3 for modulating the ETC-relevant information generated by the control unit 4 and outputted therefrom into a signal which is then fed to the vehicle-mounted antenna 1.

In this conjunction, it should be mentioned that the control unit 4 is so designed or programmed as to process the ETC-relevant information acquired after demodulation through the demodulating circuit 3-2 when the detection signal of a level higher than a predetermined one is inputted from the detecting circuit 3-1. More specifically, the ETC-relevant information sent from the overhead antenna A1 is received by the vehicle-onboard ETC apparatus to be processed by the control unit 4, only when the electric field intensity of the radio waves carrying the ETC-relevant information is higher than a predetermined level. In this way, communication between the vehicle-onboard ETC apparatus and the ETC system equipment installed at the toll gate TG can be carried out within a narrow range of radio-wave coverage area (service area), while erroneous communication with an adjacent antenna (i.e., other on-road overhead antenna) can be excluded. Thus, the toll collection transaction or toll charge/payment processing can be carried out essentially without fail.

Next, description will turn to operation of the conventional vehicle-onboard ETC apparatus of the structure described above.

By way of example, it is assumed that a motor vehicle or car equipped with the ETC apparatus 10 runs beneath the overhead antenna A1 installed at the toll gate TG. Then, the vehicle-onboard ETC apparatus 10 receives the radio wave signal carrying the information concerning the toll gate identifier which the motor vehicle currently is passing through and the toll collection information code from the ETC equipment installed at the toll gate through the medium of the overhead antenna Al and the vehicle-mounted antenna 1. The control unit 4 incorporated in the vehicle-onboard ETC apparatus 10 processes the received signal to recognize discriminatively the toll gate identifier as well as the toll collection information code, the results of which are displayed as visible information or image on the display device 5.

The driver of the car can thus confirm that his or her car is passing through a toll gate station concerned and that the toll collection processing (i.e., toll charge/payment processing) has been started by observing the screen image on the display device 5.

Furthermore, upon identification of the toll collection code being received, the control unit 4 reads out the information such as the ID number intrinsic to the motor vehicle or car concerned from an internal memory (not shown), which information is then supplied to the modulating circuit 3-3 to be thereby modulated for transmission to the overhead antenna A1 of the toll gate TG from the vehicle-mounted antenna 1.

The ETC system facility installed at the toll gate TG recognizes discriminatively the information such as the ID number and others, whereon the processing for settlement of the toll charge/payment is automatically executed for the bank account of the owner of the motor vehicle passing through the toll gate TG.

As will now be appreciated from the foregoing description, the conventional vehicle-onboard ETC apparatus (ETC-relevant communication apparatus) is so arranged as to display the ETC-relevant information interchanged through radio-wave communication between the vehicle-onboard apparatus and the ETC system facility of the toll gate in terms of image on the display device so that the driver can visibly confirm the ETC-relevant information. In that case, however, the driver's sight line will be displaced to the display screen from the forward direction in which the motor vehicle is running, thus giving rise to a problem that the driver is very likely to be deprived of his or her attention toward the forward direction at least for a moment.

As an approach for solving the problem described above, it is conceivable to provide additionally or separately a voice message output apparatus for messaging the ETC-relevant information in a voice or audibly. In that case, when the voice output apparatus dedicated for messaging audibly the ETC-relevant information is provided in addition to an audio signal output apparatus of an existing car audio system, a large proportion of area of a front panel of the motor vehicle will be thereby occupied, incurring limitation to installation of other vehicle-onboard devices and instruments.

Besides, since the vehicle-onboard ETC apparatus and the existing car audio system are functionally independent of each other, at least two external speakers will exist internally of the car when the vehicle-onboard ETC apparatus equipped with the voice message output function is installed. Needless to say, installation of these two speakers will impose limitation to the possibility installation of other vehicle-onboard devices and instruments.

Furthermore, when the ETC apparatus is to be installed on a motor vehicle, it is required to mount temporarily the vehicle-mounted antenna at a location where the reception sensitivity is considered to be favorable, whereon the field intensity for reception of the ETC-relevant information signal is measured by using a specific meter dedicated to this end. Thus, the ordinary users will encounter not a little difficulty in searching the mounting position of the vehicle antenna at which the reception field intensity, i.e., field intensity for reception of the ETC-relevant information, is favorable, giving rise to another problem.

SUMMARY OF THE INVENTION

In the light of the state of the art described above, it is an object of the present invention to solve the problems mentioned above by providing an ETC apparatus which is capable of messaging to the driver of a motor vehicle the ETC-relevant information in both image and voice without need for appreciable extension or modification of hardware structure and which is additionally capable of discriminatively determining the field strength or intensity for reception of the ETC-relevant information with the aid of voice and image without resorting to use of any specific dedicated measuring device.

In view of the above and other objects which will become apparent as the description proceeds, there is provided according to a general aspect of the present invention a vehicle-onboard ETC apparatus mounted on a motor vehicle, which apparatus includes a communication means for interchanging toll charge/payment information with a toll gate station equipped with ETC communication facility when the motor vehicle passes through the toll gate station, a signal conversion means for converting the toll charge/payment information received into an image signal and a voice signal, a display means for displaying the image signal resulting from the conversion, and a voice signal output means for outputting the voice signal resulting from the conversion to an audible signal conversion means.

By virtue of the arrangement of the vehicle-onboard ETC communication apparatus described above, the toll charge/payment information can be confirmed by the driver without being deprived of the forward view field in the course of passing through the toll gate, whereby safety driving operation can be ensured.

In a preferred mode for carrying out the invention, the voice signal output means may be arranged so as to convert the inputted voice signal into a voice through audible signal conversion means of an existing audio system installed internally of the motor vehicle.

With the arrangement of the vehicle-onboard ETC communication apparatus described above, the whole apparatus can be implemented relatively inexpensively at a low cost, to an advantageous effect.

In another preferred mode for carrying out the invention, the voice signal output means may include a signal switching means which is so designed as to output through the audible signal conversion means an audible signal supplied from the existing audio system when the voice signal is quiescent, while upon inputting of the voice signal, the signal switching means is changed over to select the voice signal for outputting the voice signal through the audible signal conversion means.

Owing to the arrangement of the vehicle-onboard ETC communication apparatus described above, the whole apparatus can be implemented inexpensively at a low cost, to another advantageous effect.

In yet another preferred mode for carrying out the invention, the signal conversion means may include a first conversion means for converting a signal level of toll charge/payment information received through the communication means into a field intensity for reception of the toll charge/payment information, and a second conversion means for converting the field intensity into an image signal such that a shape of an image represented by the image signal varies in dependence on change of magnitude of the field intensity, the image being displayed on the display means.

With the arrangement of the vehicle-onboard ETC communication apparatus described above, the field intensity for reception of the ETC-relevant information can easily be measured, to yet another advantageous effect.

In still another preferred mode for carrying out the invention, the signal conversion means may include a first conversion means for converting a signal level of toll charge/payment information received through the communication means into field intensity for reception of the toll charge/payment information, and a third conversion means for converting the field intensity resulting from the conversion into a numerical value corresponding to change of the field intensity and then converting the numerical value into an image signal to be displayed on the display means.

With the arrangement of the vehicle-onboard ETC communication apparatus described above, the field intensity for reception of the ETC-relevant information can accurately be measured, to yet another advantageous effect.

In a further preferred mode for carrying out the invention, the signal conversion means may include a fourth conversion means for converting the field intensity for reception of the toll charge/payment information as outputted from the first conversion means into an acoustic signal the level of which varies in dependence on change of the field intensity, the acoustic signal being outputted as a sound from the audible signal conversion means.

Owing to the arrangement of the vehicle-onboard ETC communication apparatus described above, the location where the field intensity for reception of the ETC-relevant information can be determined with high effective means.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which.

DESCRIPTION OF THE PREFERRED EMBODIMENTS

Figure 1:
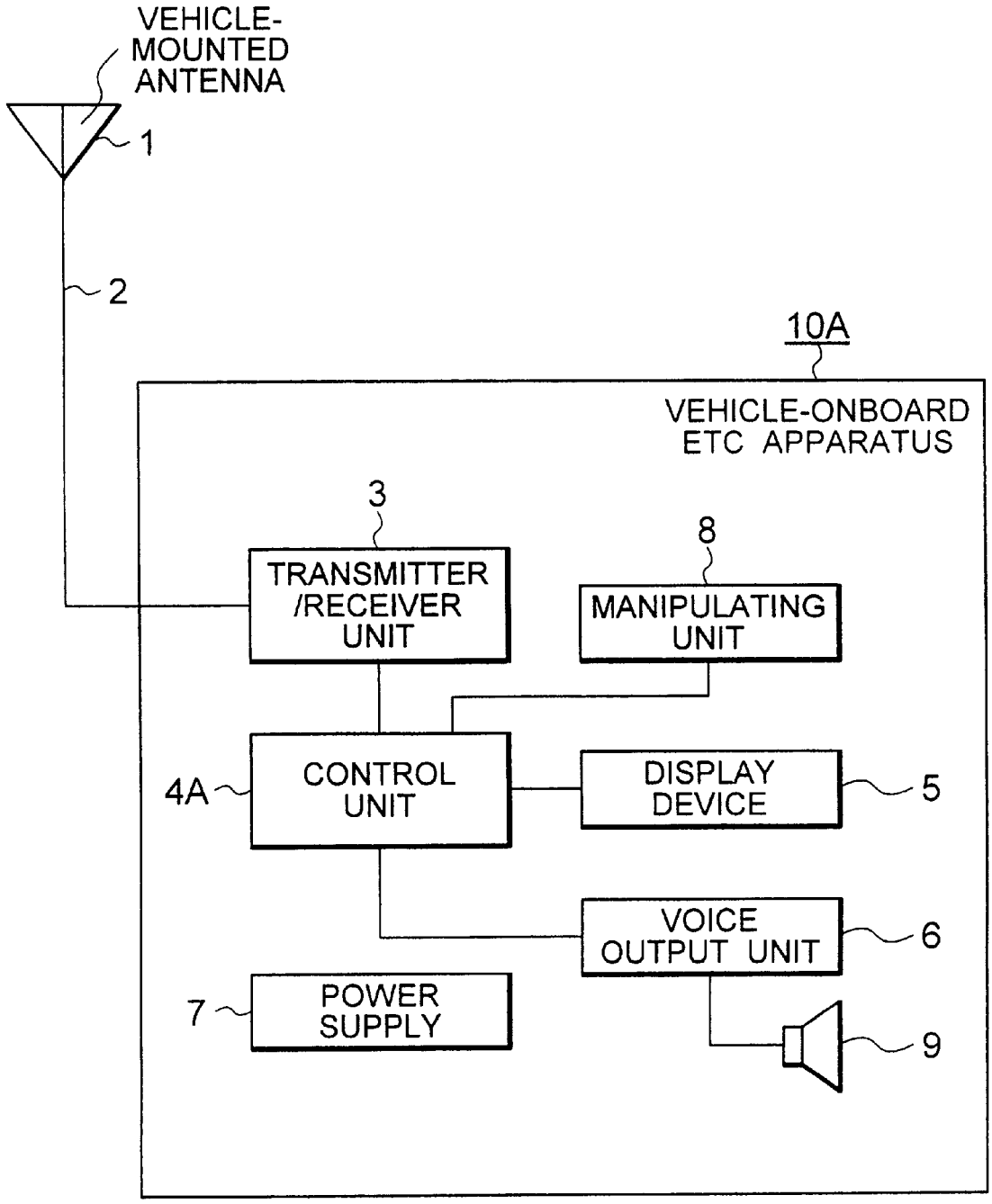
FIG. 1 is a block diagram showing generally and schematically a structural arrangement of a vehicle-onboard ETC apparatus according to a first embodiment of the present invention.

The present invention will be described in detail in conjunction with what is presently considered as preferred or typical embodiments thereof by reference to the drawings. In the following description, like reference characters designate like or corresponding parts throughout the several views.

Embodiment 1

FIG. 1 is a block diagram showing generally a structure of the vehicle-onboard ETC apparatus according to a first embodiment of the present invention. In the figure, reference 4A denotes a control unit incorporated in the vehicle-onboard ETC apparatus 10A according to the instant embodiment of the invention which is imparted with a function for converting the ETC (Electronic Toll Collection) information to be displayed on a display device 5 into a synthesized voice signal by means of a microcomputer (not shown) in addition to the functions of the control unit 4 incorporated in the conventional vehicle-onboard ETC apparatus 10 described hereinbefore. Further, reference numeral 6 denotes a voice-output unit for converting the synthesized voice signal outputted from the control unit 4A into an analogue voice signal which is then generated as voice information by an internal speaker serving as the acoustic conversion means 9.

Figure 2:
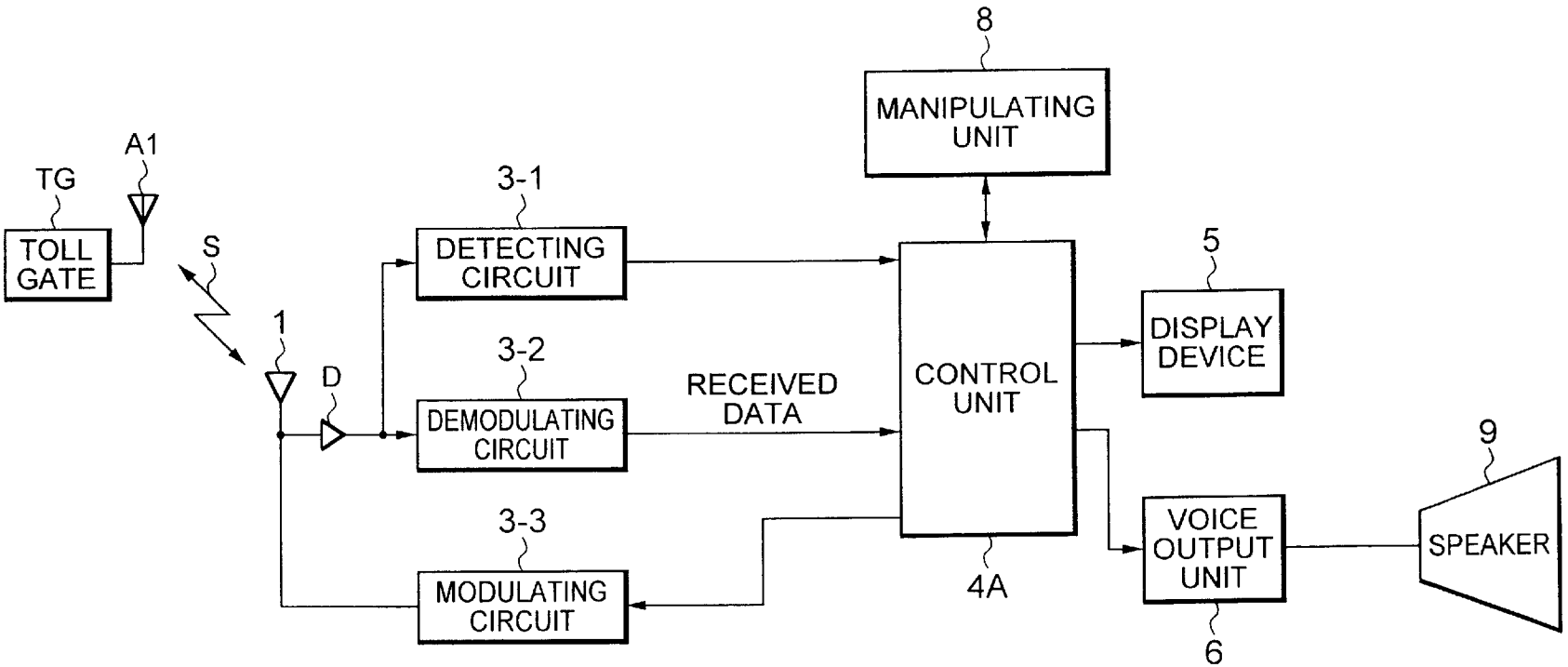
FIG. 2 is a block diagram showing schematically a structure of a transmitting/receiving unit incorporated in the vehicle-onboard ETC apparatus according to the first embodiment of the invention.

FIG. 2 is a view for illustrating a relation of interconnection between a transmitting/receiving unit 3 and the control unit 4A for performing ETC-relevant information communication with a toll gate TG. When the received data representing the ETC-relevant information inputted from a demodulating circuit 3-2 is inputted, the control unit 4A converts the received data into a signal for image display, e.g. video signal, which is then supplied to the display device 5, whereby the ETC-relevant information containing the toll gate name or identifier and a toll collection information code are displayed on the display device.

Furthermore, the control unit 4A is so designed as to convert the received data into a synthesized voice signal which is then inputted to the voice-output unit 6, as a result of which the toll gate identifier or name as well as the toll collection information code contained in the ETC-relevant information are outputted from the internal speaker 9 in the form of a voice message.

In this manner, the driver can acquire the ETC-relevant information in the form of voice information in the course of passing through the toll gate and thus can concentrate his or her attention only to driving of the motor vehicle without need to view the information on the display screen. Thus, safety operation or careful driving can be ensured. Furthermore, because the voice output function is incorporated in the vehicle-onboard ETC apparatus, the voice-output unit which is constituted by the internal speaker and others does not occupy a large space available within the motor vehicle.

Embodiment 2

In the case of the vehicle-onboard ETC apparatus according to the first embodiment of the invention, the voice-output unit 6 and the internal speaker 9 are incorporated in the vehicle-onboard ETC apparatus 10A. However, because the vehicle-onboard ETC apparatus is ordinarily implemented on an extremely small scale, the internal speaker must necessarily be of a small size with low sound volume. Under the circumstances, there may arise such situation that the driver of a motor vehicle feels a great difficulty in discerning audibly the ETC voice information produced by the internal speaker.

Thus, according to the invention incarnated in the instant embodiment, it is taught that the voice signal outputted from the voice-output unit is supplied to an external speaker of an existing car audio system installed already internally of the motor vehicle or car, so that the driver can hear the ETC voice information through the medium of the external speaker. By virtue of this arrangement, the ETC-relevant information can be conveyed to the driver with a proper sound volume at a high sound quality.

Figure 3:
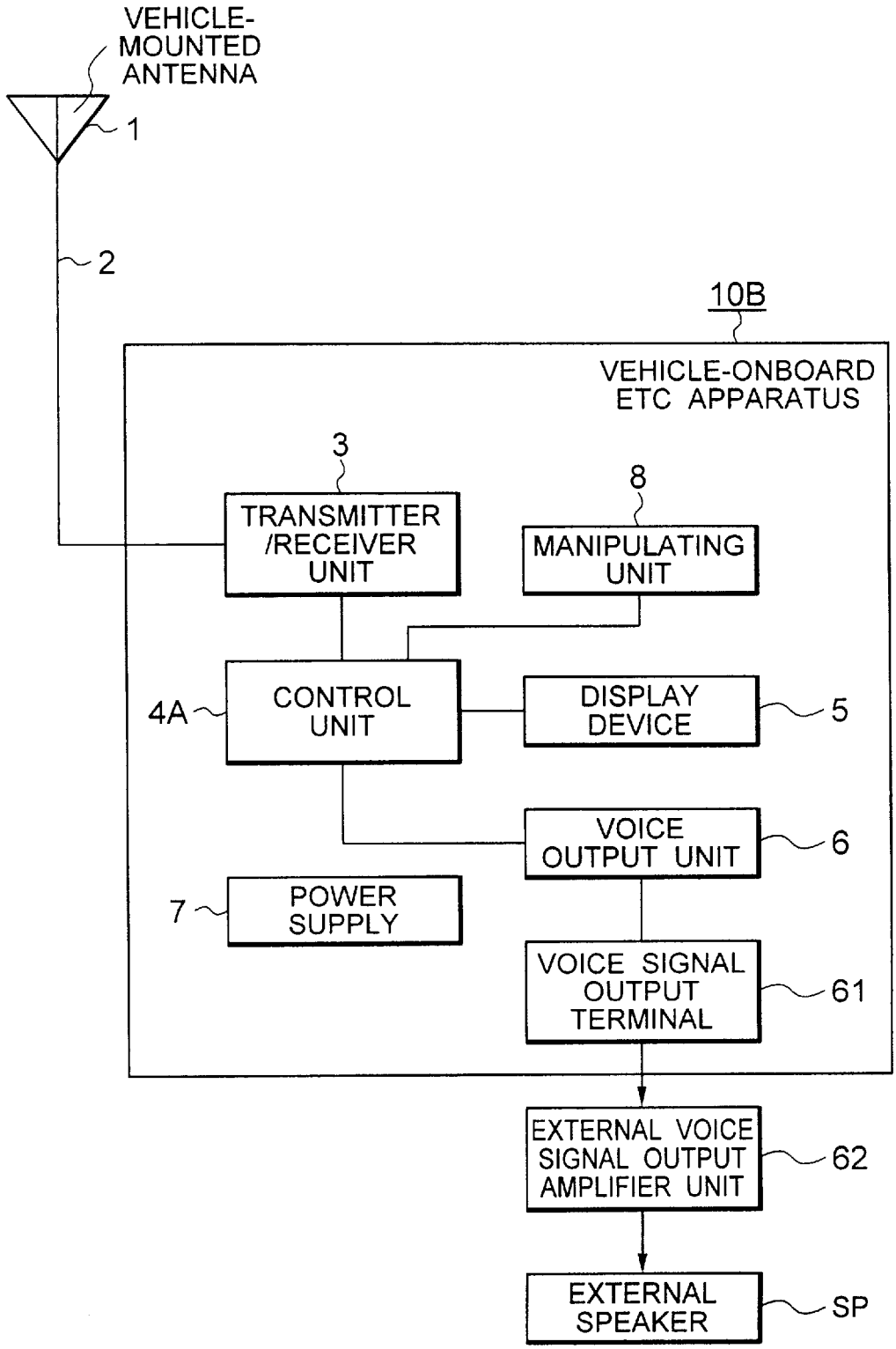
FIG. 3 is a block diagram showing generally and schematically a structural arrangement of a vehicle-onboard ETC apparatus according to a second embodiment of the present invention.

FIG. 3 is a block diagram showing generally and schematically a structure of the vehicle-onboard ETC apparatus according to a second embodiment of the present invention. In this figure, reference character 10B denotes the main body of the vehicle-onboard ETC apparatus. In this vehicle-onboard ETC apparatus 10B, the output of the voice-output unit 6 is led out through a voice signal output terminal 61 mounted integrally on the vehicle-onboard ETC apparatus 10B. The voice signal outputted through the voice signal output terminal 61 is fed to an external speaker SP after having been amplified by an external voice signal output amplifier unit 62.

Figure 4:
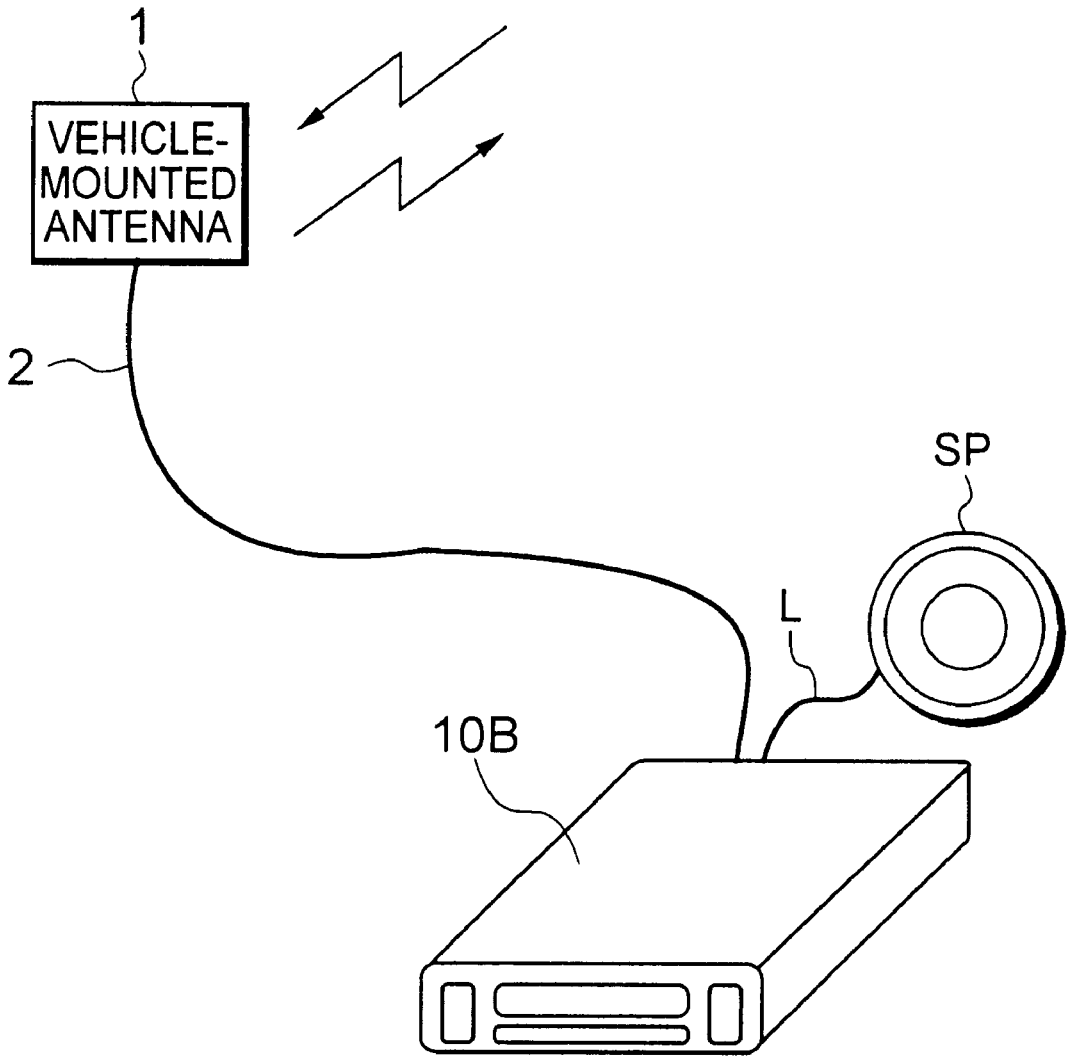
FIG. 4 is a perspective view showing as a whole the structure of the vehicle-onboard ETC apparatus according to the second embodiment of the present invention.

FIG. 4 is a diagram for illustrating pictorially a connection state in which the external speaker SP is electrically connected to the vehicle-onboard ETC apparatus 10B by way of a vehicle-mounted lead wire L and in which the vehicle-onboard ETC apparatus 10B is electrically connected to a vehicle-mounted antenna 1 through medium of a cable dedicated for interconnecting vehicle-mounted devices/instruments. Incidentally, illustration of the external voice signal output amplifier unit 62 is omitted in FIG. 3.

Next, description will turn to operation of the vehicle-onboard ETC apparatus according to the second embodiment of the invention.

In the case of the vehicle-onboard ETC apparatus now concerned, the voice signal outputted from the voice-output unit 6 is supplied to the external voice signal output amplifier unit 62 installed externally of the vehicle-onboard ETC apparatus through the voice signal output terminal 61. The reason why the external voice signal output amplifier unit 62 is provided can be explained by the fact that since the voltage level of the voice signal outputted from the voice-output unit 6 is ordinarily relatively low due to low capacity of the power supply source incorporated in the vehicle-onboard ETC apparatus 10B, an excessively large current will flow through the voice-output unit 6 when the voice signal is fed directly to the external speaker SP with an attempt to obtain a high sound volume, which may result in that the vehicle-onboard ETC apparatus 10B suffers unwantedly suffer a damage due to lowering of voltage level.

When the voice signal is inputted to the external voice signal output amplifier unit 62, the voltage level of the voice signal is amplified by the external voice signal output amplifier unit 62 to an increased level. Thus, the ETC-relevant information can be audibly conveyed to the driver of the motor through the external speaker SP with a sufficiently large sound volume.

Embodiment 3

Figure 5:
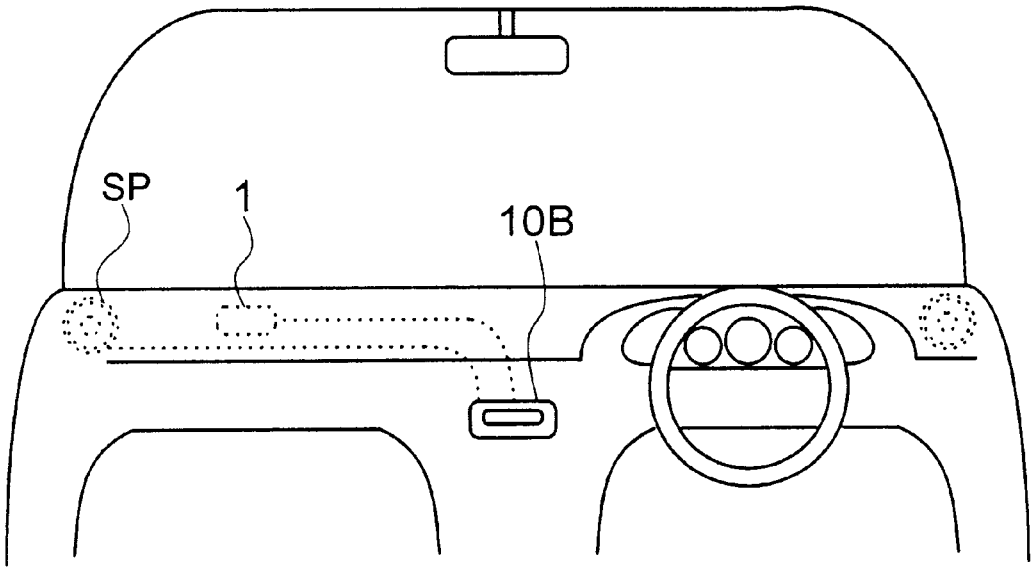
FIG. 5 is a block diagram showing generally and schematically a system configuration of a vehicle-onboard ETC apparatus according to a third embodiment of the present invention.

The above description of the vehicle-onboard ETC apparatus according to the second embodiment of the invention has been made on the presumption that the external speaker SP and the vehicle-mounted antenna 1 are disposed at a predetermined position at the inner side of the front window shield of the motor vehicle. According to the teaching of the invention incarnated in a third embodiment thereof, it is proposed that the external speaker SP and the vehicle-mounted antenna 1 are accommodated within a glove box disposed in front of an assistant driver's seat, wherein the external speaker SP and the vehicle-mounted antenna 1 are electrically connected to the vehicle-onboard ETC apparatus 10B through dedicated lead wire and cable within the glove box, as illustrated in FIG. 5. Owing to such arrangement, the relatively restricted intra-car space can effectively be utilized for installing the vehicle-onboard ETC apparatus 10B on the motor vehicle.

Embodiment 4

In the vehicle-onboard ETC apparatus according to the second embodiment of the invention, the external voice signal output amplifier unit is provided for amplifying or enhancing the voltage level of the voice signal outputted from the vehicle-onboard ETC apparatus before feeding the voice signal to the external speaker. By contrast, in the vehicle-onboard ETC apparatus according to a fourth embodiment of the invention, there is provided a speaker which is capable of producing sound with a high quality at a large sound volume level. To this end, the voice output function of a car audio system equipped with a speaker driving circuit is made use of for amplifying the voice signal outputted from the vehicle-onboard ETC apparatus to thereby allow the ETC-relevant information to be outputted from the above-mentioned speaker as the voice information.

Figure 6:
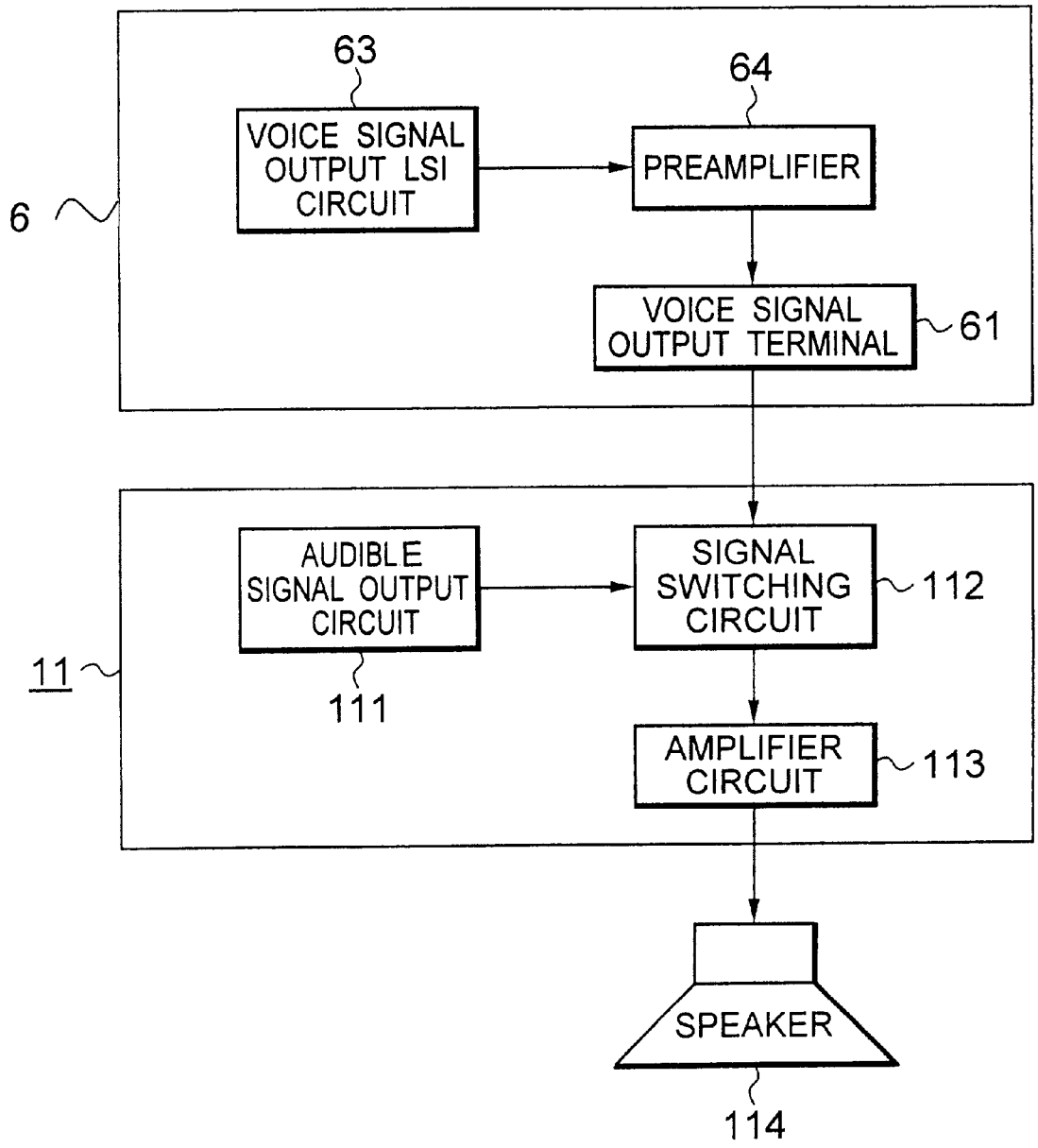
FIG. 6 is a block diagram showing a combination of a voice output unit incorporated in the vehicle-onboard ETC apparatus according to a fourth embodiment of the present invention and a hitherto known car audio system.

FIG. 6 is a block diagram illustrating a combination of the vehicle-onboard ETC apparatus and the car audio system according to the fourth embodiment of the present invention, wherein the voice signal outputted from the vehicle-onboard ETC apparatus is supplied to the car audio system to thereby output the ETC-relevant information signal in voice through an existing speaker.

In the figure, reference numeral 6 denotes a voice output unit of the vehicle-onboard ETC apparatus according to the instant embodiment of the present invention. The voice output unit is comprised of a voice signal output LSI (Large Scale Integrated) circuit 63 incorporating a microcomputer which is designed or programmed to synthesize the ETC-relevant information for communication or transaction with the toll gate station into a voice signal for thereby outputting the ETC-relevant information as a synthesized voice signal, a preamplifier 64 for amplifying the synthesized voice signal, and a voice signal output terminal 61 for outputting externally the amplified synthesized voice signal. The voice signal output LSI circuit 63 is designed or programmed to generate the synthesized voice signal of the ETC-relevant information on the basis of the ETC-relevant information inputted from the control unit 4A (refer to FIG. 3).

Further in FIG. 6, reference numeral 11 denotes a switching unit for switching or changing over the audible signal outputted from an audible signal output circuit 111 constituting a part of the car audio system with the synthesized voice signal outputted from the voice output unit 6 of the vehicle-onboard ETC apparatus. The switching unit 11 is comprised of a signal switching circuit 112 which responds to reception of the synthesized voice signal outputted from the voice output signal 6 by way of the voice signal output terminal 61 to thereby change over the audible signal outputted from the audible signal output circuit 111 of the car audio system to the synthesized voice signal received from the voice signal output terminal 61, and an output amplifier circuit 113 imparted with an AGC (Automatic Gain Control) function for amplifying the level of the signal outputted from the signal switching circuit 112 to a voltage level sufficiently high for driving the speaker 114.

Parenthetically, the signal switching circuit 112 is so designed that when the motor vehicle is running on an ordinary road as well as before and after passage through the toll gate station on the toll road, the audible signal outputted from the audible signal output circuit 111 is supplied to the amplifier circuit 113 and that upon reception of the synthesized voice signal from the external voice output terminal 61, the audible signal fed from the car audio system until then is changed over to the synthesized voice signal to be subsequently supplied to the amplifier circuit 113.

Figure 7:
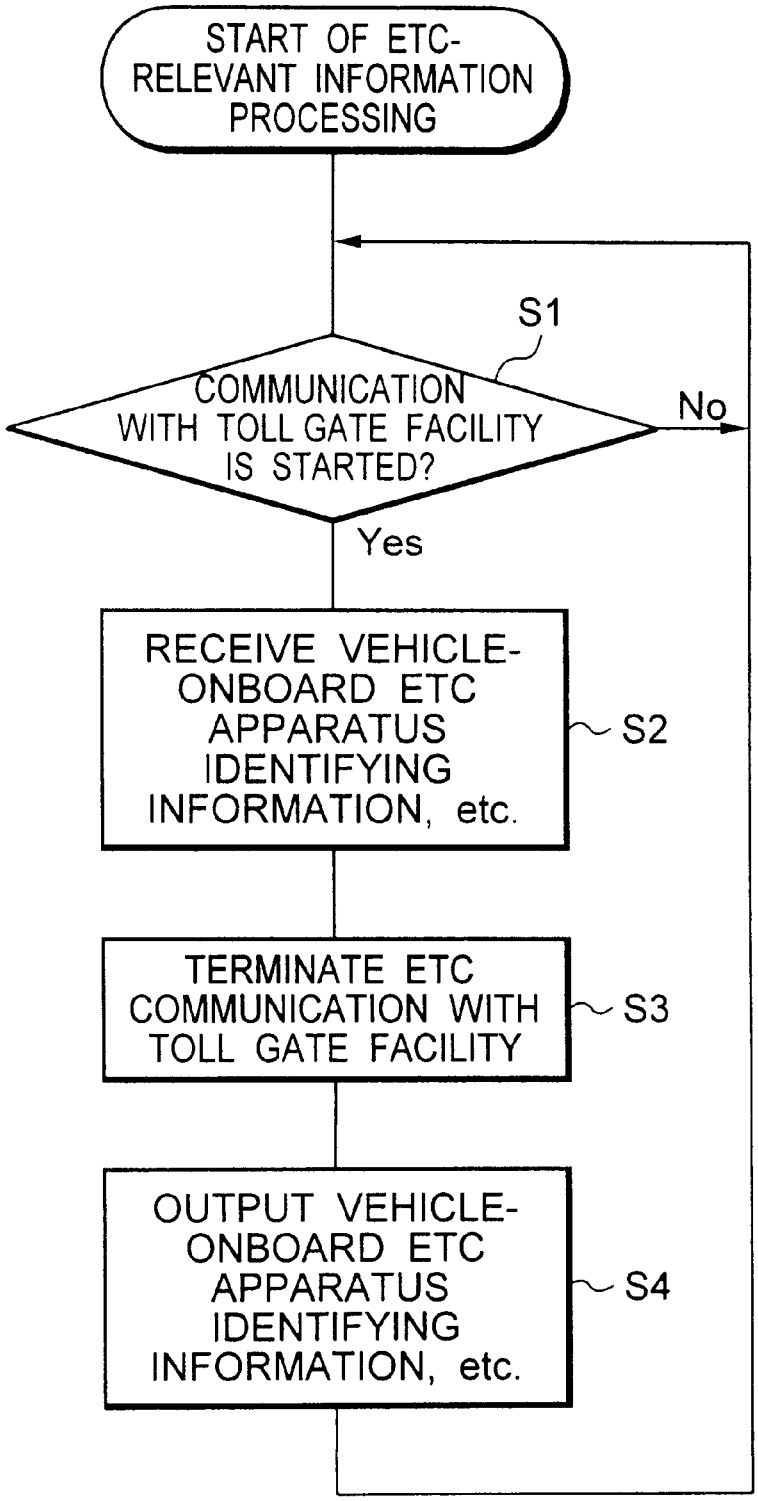
FIG. 7 is a flow chart for illustrating operation of the vehicle-onboard ETC apparatus according to the fourth embodiment of the invention.

Now, operation of the vehicle-onboard ETC apparatus according to the instant embodiment of the invention will be described by also referring to the flow chart shown in FIG. 7.

When it is detected by the control unit 4A (refer to FIG. 1) that the ETC-relevant information signal of a predetermined level has been received by the transmitting/receiving unit 3 (also refer to FIG. 1), the control unit 4A then decides that the motor vehicle equipped with the ETC apparatus concerned has entered the area or region capable of starting the ETC-relevant information communication with an overhead antenna of the ETC communication equipment installed at the toll gate station (step S1). Upon starting of the ETC communication, the vehicle-onboard ETC apparatus identification information (ETC-relevant information) sent from the toll gate station is received through the vehicle-mounted antenna (step S2).

Upon reception of the ETC-relevant information, the transmitting/receiving unit 3 exchanges information with the ETC communication equipment of the toll gate station for settlement of the road toll charge/payment. When the ETC-relevant information exchange process has been completed (step S3), the control unit 4A converts the ETC-relevant information necessary for the driver into an image signal (video signal) which is then outputted to the display device 5 to be presented to the driver as the visible information (step S4).

Further, the ETC-relevant information is outputted to the voice output unit 6 where the ETC-relevant information is synthesized into the voice signal by means of the voice signal output LSI circuit 63 to be subsequently supplied to the preamplifier 64. After having been amplified by the preamplifier 64, the synthesized voice signal is inputted to the signal switching circuit 112 incorporated in the switching unit 11 from the voice signal output terminal 61.

Upon reception of the synthesized voice signal from the voice signal output terminal 61, the signal switching circuit 112 changes over the audible signal outputted from the audible signal output circuit 111 of the car audio system to the synthesized voice signal supplied through the voice signal output terminal 61, whereby the synthesized voice signal is amplified by the amplifier circuit 113 to be fed to the external speaker 114 (step S4).

In this manner, the ETC-relevant information can audibly be presented or messaged to the driver with a high sound quality by making use of the voice output unit of the existing car audio system.

Embodiment 5

In the case of the vehicle-onboard ETC apparatuses according to the first to fourth embodiments of the invention described above, the contents of the ETC-relevant information are displayed on the display device 5. In this conjunction, it should be noted that the signal level of the ETC-relevant information inputted from the transmitting/receiving unit 3 can also be converted into a signal indicative of the reception field intensity level to be displayed.

More specifically, the signal level of the ETC relevant information inputted from the transmitting/receiving unit 3 is converted into the reception field intensity, (i.e., the intensity or strength of the ETC-relevant information radio waves received), and the magnitude thereof is displayed graphically on the display device 5 in the form of numerical value or graphic bars. In this conjunction, it should also be added that the reception field intensity is converted into an acoustic signal level for activating the speaker. A fifth embodiment of the present invention is directed to the arrangement described above.

Incidentally, the control unit 4A constitutes the signal conversion means including the first to fourth converting means.

Figure 8A:
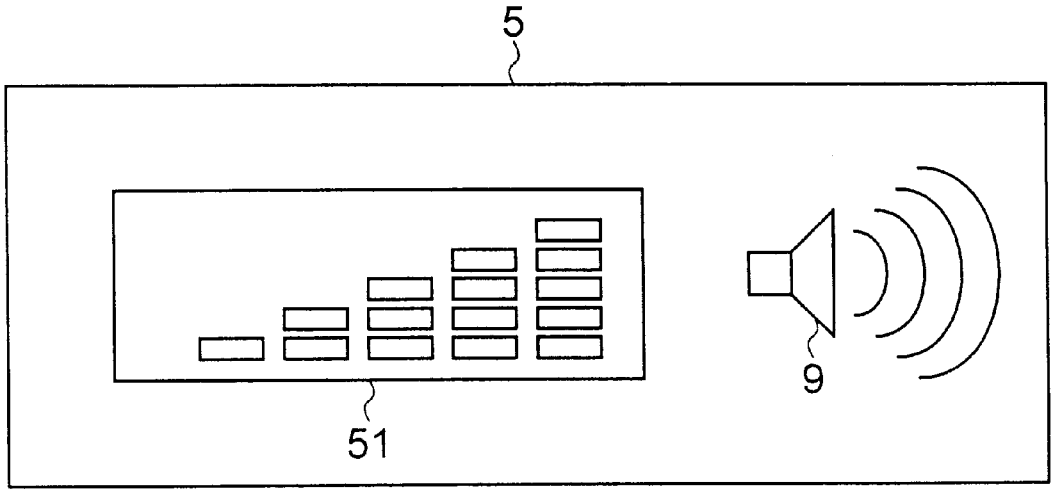
FIGS. 8A and 8B are diagrams for illustrating exemplary images, respectively, which are generated on a display device of the vehicle-onboard ETC apparatus according to a fifth embodiment of the present invention.
Figure 8B:
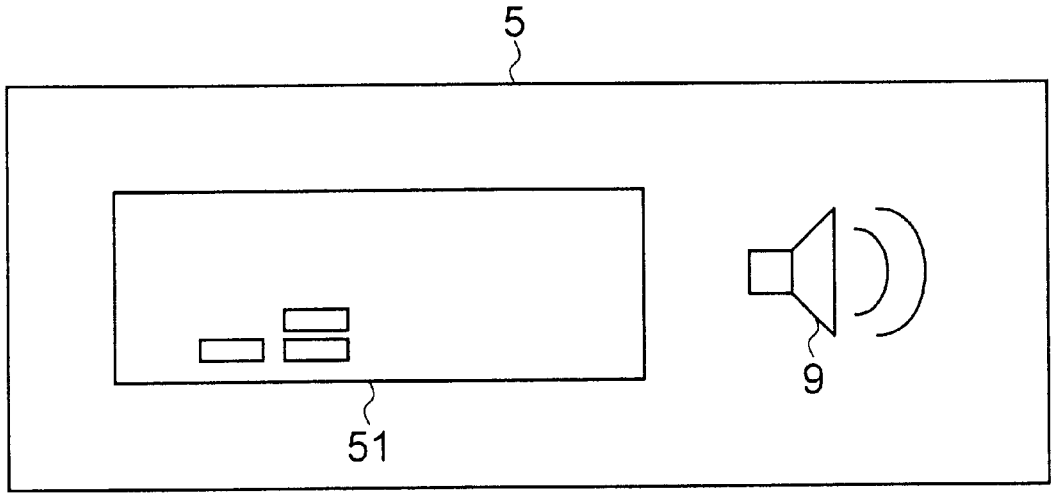
Figure 9:
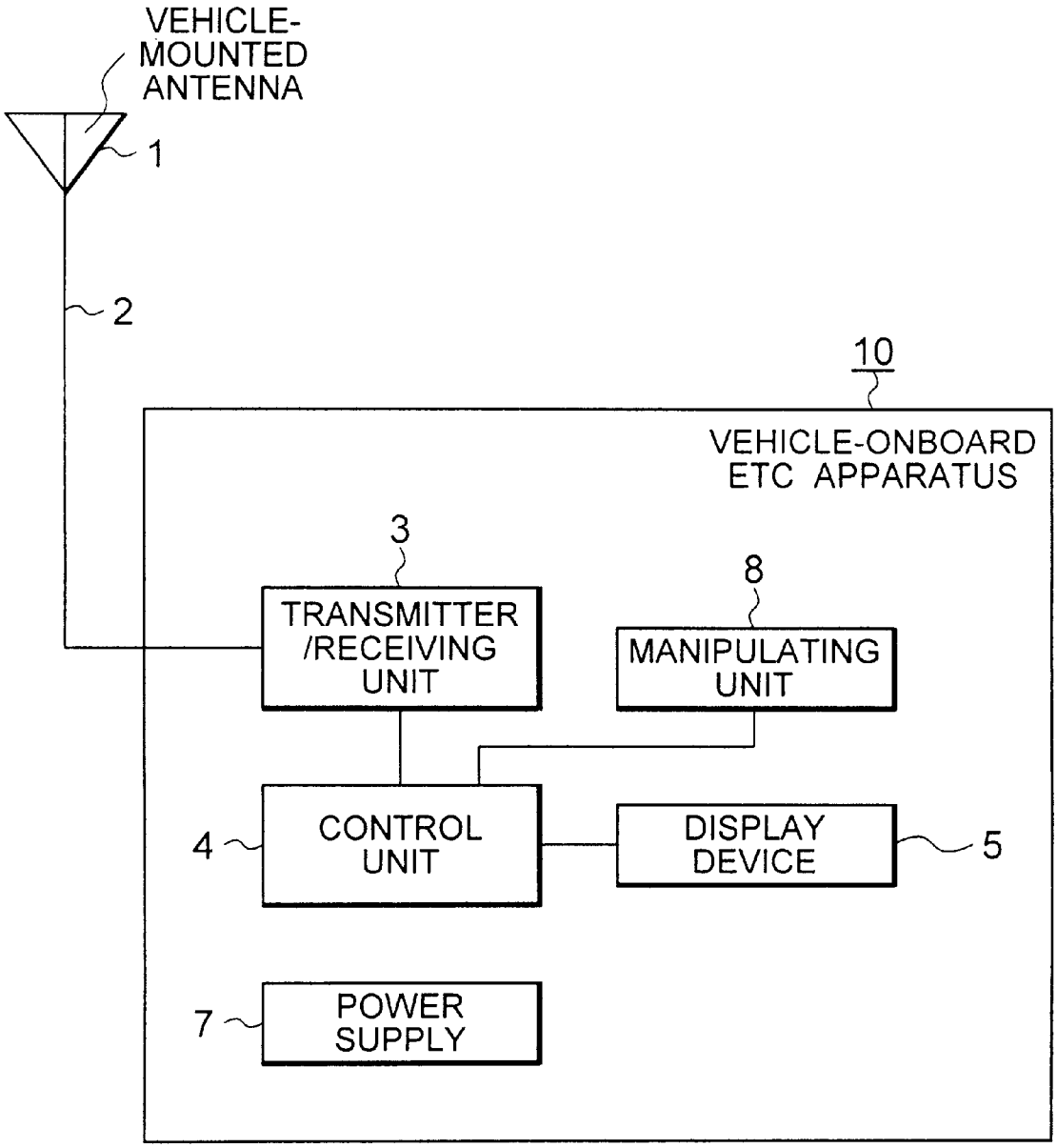
FIG. 9 is a block diagram showing schematically a structure of a conventional vehicle-onboard ETC apparatus.
Figure 10:
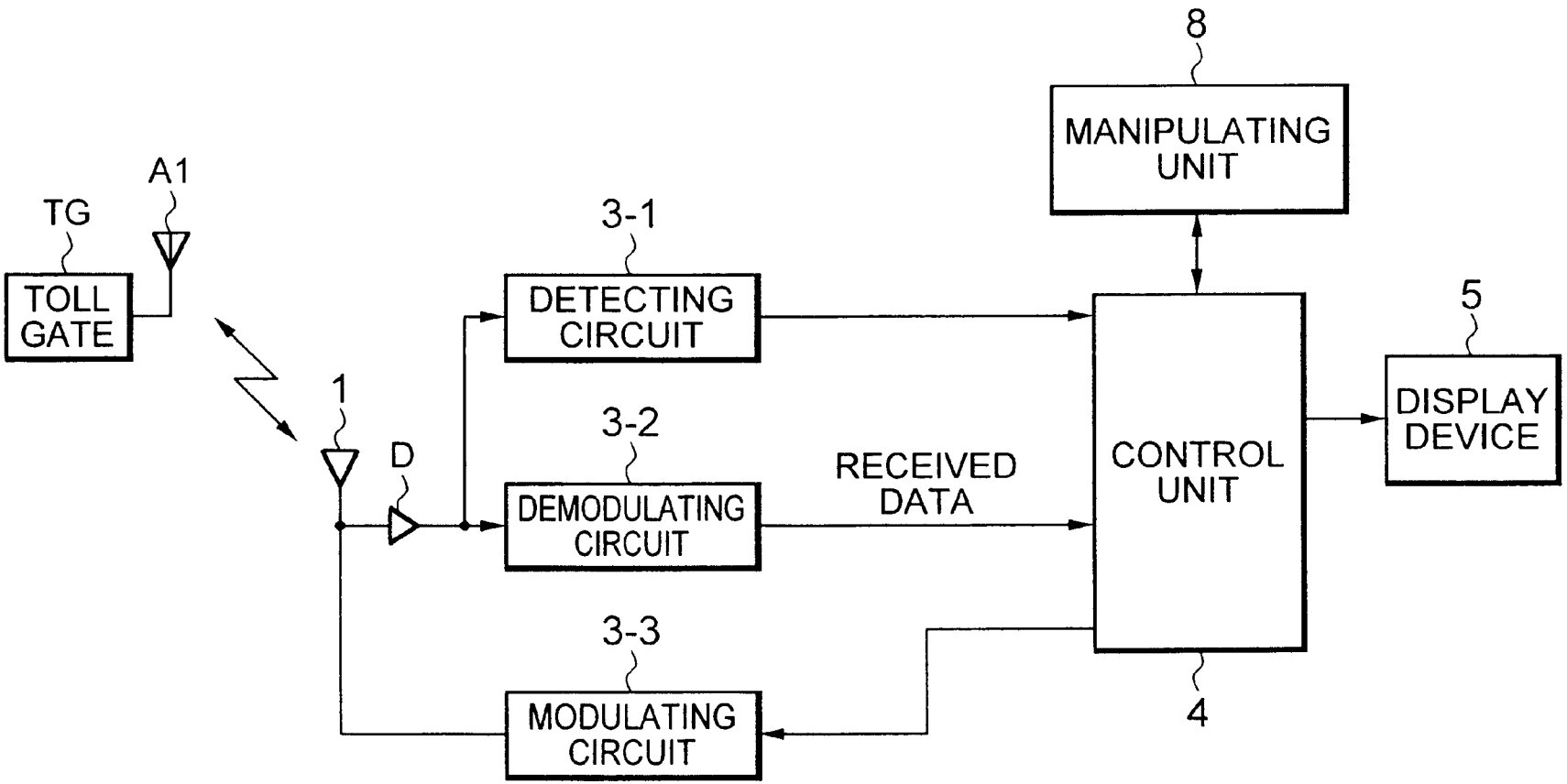
FIG. 10 is a block diagram showing a structure of a transmitting/receiving unit incorporated in the conventional vehicle-onboard ETC apparatus.

FIGS. 8A and 8B illustrate, by way of example only, the states in which the reception field intensity is being graphically displayed in the form of bar graph.

Operations of the vehicle-onboard ETC apparatus imparted with the display function described above may be adjusted or regulated by the user in the following manner. Namely, after having installed the vehicle-onboard ETC apparatus on a motor vehicle, the user places the motor vehicle at a location in the vicinity of a toll gate station in which the ETC communication system is adopted. Subsequently, the ETC-relevant information is received while changing the mounted position of the vehicle-mounted antenna 1 internally of the motor vehicle, and then, the reception level of the ETC-relevant information is displayed on the screen of the display device 5 as the reception field intensity data.

By disposing the ETC communication antenna, i.e., the antenna for the motor vehicle, at the position where the reception field intensity is highest, all the graphic bars inclusive of the one indicating the lowest reception field intensity to that indicating the highest reception field intensity are displayed on the display screen 51, as is illustrated in FIG. 8A. On the other hand, for confirming acoustically the status of the reception field intensity, a signal sound of sound volume equivalent to the signal level of the received ETC-relevant information is generated from the internal speaker 9 through a corresponding signal processing executed by the control unit 4A.

On the other hand, in case the reception field intensity at the position where the vehicle dedicated antenna is installed is unfavorably low, the image on the displaying screen 51 of the display device 5 will include only two graphic bars, indicating a low reception field intensity level, as is illustrated in FIG. 8B. Besides, the volume of the signal sound generated by the speaker 9 is also low when compared with the case where the reception field intensity is favorably high.

In this way, the location for disposition of the ETC communication antenna where the reception field intensity is most favorable can be determined without resorting to the use of any other specific field intensity measuring device.

Many features and advantages of the present invention are apparent from the foregoing detailed description and thus it is intended by the appended claims to cover all such features and advantages of the system which fall within the true spirit and scope of the invention. Further, since numerous modifications and combinations will readily occur to those skilled in the art, it is not intended to limit the invention to the exact construction and operation illustrated and described.

By way of example, in the foregoing description of the vehicle-onboard ETC apparatus according to the fifth embodiment of the invention, it has been presumed that the reception field intensity is displayed in the form of graphic bars. It should however be understood that the image display mode is never restricted to such graphical bar representation but any type or species of image may be employed so long as the shape or form of the image varies in correspondence to the changes in the reception field intensity level. By way of example, the change of the reception field intensity may be displayed in the form of an image whose color shade or density varies correspondingly.

Furthermore, the change of the reception field intensity may be represented in terms of change of the numerical value, which may equally be displayed on the display screen. Of course, change of the numerical value may be messaged in voice. In brief, any medium may be employed which can convey visually and/or acoustically the change of the reception field intensity to the user or driver.

Accordingly, all suitable modifications and equivalents may be resorted to, falling within the spirit and scope of the invention.

What is claimed is:

1. A vehicle-onboard electronic toll collection apparatus mounted on a motor vehicle, comprising:

communication means for interchanging toll charge/payment information with a toll gate station equipped with electronic toll collection communication facility when said motor vehicle passes through said toll gate station;

signal conversion means for converting received information of said toll charge/payment information into an image signal and a voice signal;

display means for displaying an image corresponding to said image signal; and voice signal output means for outputting said voice signal to audible signal conversion means, said voice signal output means comprising signal switching means for outputting through said audible signal conversion means an audio signal supplied from an existing audio system of said vehicle when said voice signal is quiescent and, when said voice signal is active, outputting said voice signal through said audible signal conversion means.

2. A vehicle-onboard electronic toll collection apparatus mounted on a motor vehicle, said vehicle-onboard electronic toll collection apparatus comprising:

communication means for interchanging toll charge/payment information with a toll gate station equipped with electronic toll collection communication facility when said motor vehicle passes through said toll gate station;

signal conversion means for converting received information of said toll charge/payment information into an image signal and a voice signal;

display means for displaying an image corresponding to said image signal; and voice signal output means for outputting said voice signal to audible signal conversion means, said voice signal output means converting said voice signal into a voice through an existing audio system installed internally of said motor vehicle.

3. A vehicle-onboard electronic toll collection apparatus according to claim 2, wherein said voice signal output means includes signal switching means for outputting audio information from said existing audio system when said voice signal is quiescent and, when said voice signal is active, disabling said outputting of said audio information and outputting said voice signal through said audible signal conversion means.

4. A vehicle-onboard electronic toll collection apparatus mounted on a motor vehicle, comprising:

communication means for interchanging toll charge/payment information with a toll gate station equipped with electronic toll collection communication facility when said motor vehicle passes through said toll gate station;

signal conversion means for converting received information of said toll charge/payment information into an image signal and a voice signal, said signal conversion means comprising:

first conversion means for converting a signal level of toll charge/payment information received through said communication means into a field intensity value for said received toll charge/payment information; and second conversion means for converting said field intensity value into an image signal such that a shape of an image represented by said image signal varies in dependence on a change of magnitude of said field intensity value, said apparatus further comprising:

display means for displaying said image corresponding to said image signal; and voice signal output means for outputting said voice signal to audible signal conversion means.

5. A vehicle-onboard electronic toll collection apparatus according to claim 4, wherein said signal conversion means includes:

fourth conversion means for converting said field intensity value for said received toll charge/payment information from said first conversion means into an acoustic signal the level of which varies in dependence on a change of said field intensity value, said acoustic signal being outputted as a sound from said audible signal conversion means.

6. A vehicle-onboard electronic toll collection apparatus mounted on a motor vehicle, comprising:

communication means for interchanging toll charge/payment information with a toll gate station equipped with electronic toll collection communication facility when said motor vehicle passes through said toll gate station;

signal conversion means for converting received information of said toll charge/payment information into an image signal and a voice signal, said signal conversion means comprising:

first conversion means for converting a signal level of toll charge/payment information received through said communication means into a field intensity value for said received toll charge/payment information; and third conversion means for converting said field intensity value into a numerical value corresponding to a change of said field intensity value and then converting said numerical value into an image to be displayed on said display means, said apparatus further comprising:

display means for displaying said image corresponding to said image signal; and voice signal output means for outputting said voice signal to audible signal conversion means.

7. A vehicle-onboard electronic toll collection apparatus according to claim 6, wherein said signal conversion means includes:

fourth conversion means for converting the field intensity value for said received toll charge/payment information from said first conversion means into an acoustic signal the level of which varies in dependence on a change of said field intensity value, said acoustic signal being outputted as a sound from said audible signal conversion means.

8. A vehicle-onboard electronic toll collection apparatus mounted on a motor vehicle, comprising:

a receiver/transmitter operative to interchange toll charge/payment information with a toll gate station equipped with electronic toll collection communication facility when said motor vehicle passes through said toll gate station;

a signal converter operative to convert received information of said toll charge/payment information into an image signal and a voice signal;

a display operative to display an image corresponding to said image signal; and an audio output unit operative to receive said voice signal and output a sound signal to a sound reproduction device, said audio output unit comprising a signal switch operative to output said sound signal as a signal supplied from an existing audio system of said vehicle when said voice signal is quiescent and, when said voice signal is active, to output said voice signal instead of said signal supplied from said existing audio system.

9. An apparatus according to claim 8, wherein said sound signal is a synthesized speech signal.

10. An apparatus according to claim 8, wherein said audio output unit is operative to convert said voice signal into a voice through an existing audio system installed internally of said motor vehicle.

11. A vehicle-onboard electronic toll collection apparatus mounted on a motor vehicle, comprising:

a receiver/transmitter operative to interchange toll charge/payment information with a toll gate station equipped with electronic toll collection communication facility when said motor vehicle passes through said toll gate station;

a signal converter operative to convert received information of said toll charge/payment information into an image signal and a voice signal, said signal converter comprising:

a field intensity circuit operative to convert a signal level of received information of said toll charge/payment information into a field intensity value; and an image signal circuit operative to convert said field intensity value into said image signal, such that an image parameter based on said image signal varies in dependence on a change of magnitude of said field intensity value; said apparatus further comprising:

a display operative to display said image corresponding to said image signal; and an audio output unit operative to receive said voice signal and output a sound signal to a sound reproduction device.

12. An apparatus according to claim 12, wherein said signal converter comprises:

an acoustic signal circuit operative to convert said field intensity value for said received toll charge/payment information into an acoustic signal the level of which varies in dependence on a change of said field intensity value, said acoustic signal being outputted as a sound from said sound reproduction device.

13. A vehicle-onboard electronic toll collection apparatus mounted on a motor vehicle, comprising:

a receiver/transmitter operative to interchange toll charge/payment information with a toll gate station equipped with electronic toll collection communication facility when said motor vehicle passes through said toll gate station;

a signal converter operative to convert received information of said toll charge/payment information into an image signal and a voice signal, said signal converter comprising:

a field intensity circuit operative to convert a signal level of received information of said toll charge/payment information into a field intensity value; and a numerical conversion circuit operative to convert said field intensity value into a numerical value corresponding to a change of said field intensity value and then convert said numerical value into said image signal; said apparatus further comprising:

a display operative to display said image corresponding to said image signal; and an audio output unit operative to receive said voice signal and output a sound signal to a sound reproduction device.

14. An apparatus according to claim 13, wherein said signal converter further comprises:

an acoustic signal circuit operative to convert said field intensity value for said received toll charge/payment information into an acoustic signal the level of which varies in dependence on a change of said field intensity value, said acoustic signal being outputted as a sound from said sound reproduction device.

15. A method of processing electronic toll collection (ETC) information in a vehicle mounted ETC apparatus, comprising:

detecting that a communication of ETC information above a predetermined signal level has been received by an ETC receiver/transmitter from a toll gate ETC system;

exchanging ETC information between said apparatus and said toll gate ETC system;

converting received information of said exchanged ETC information into an image signal and displaying an image based on said image signal to a driver of said vehicle as a visible display;

converting said received information into a synthesized voice signal, amplifying said synthesized voice signal, and reproducing a voice corresponding to said synthesized voice signal to said driver through a sound reproduction device.

16. A method according to claim 15, wherein said reproduction device is an existing audio system of said vehicle that performs said amplifying and said reproducing, said existing audio system having an existing audio output, the method further comprising switching off said existing audio output when said synthesized voice signal is non-quiescent, whereby said reproducing said voice replaces said existing audio output.

* * * * *